US009382089B2

(12) United States Patent
Tanaka et al.

(10) Patent No.: US 9,382,089 B2
(45) Date of Patent: Jul. 5, 2016

(54) PAPER TRANSPORTING DEVICE, IMAGE FORMING APPARATUS, IMAGE READING DEVICE AND POST-PROCESSING DEVICE

(75) Inventors: Yasuki Tanaka, Kanagawa (JP); Yukihiro Ichiki, Kanagawa (JP); Motoyuki Yagi, Kanagawa (JP); Tahei Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 301 days.

(21) Appl. No.: 12/875,166

(22) Filed: Sep. 3, 2010

(65) Prior Publication Data

US 2011/0222944 A1 Sep. 15, 2011

(30) Foreign Application Priority Data

Mar. 10, 2010 (JP) ..... 2010-053806

(51) Int. Cl.
*B65H 29/20* (2006.01)
*B65H 5/06* (2006.01)
(Continued)

(52) U.S. Cl.
CPC ..... *B65H 29/52* (2013.01); *B65H 5/062* (2013.01); *B65H 5/36* (2013.01); *B65H 29/70* (2013.01); *B65H 31/02* (2013.01); *B65H 31/20* (2013.01);
(Continued)

(58) Field of Classification Search
CPC ..... B65H 5/068; B65H 2301/51214; B65H 29/22; B65H 29/70; B65H 5/06; B65H 2404/13171; B65H 2404/141; B65H 2601/251; B65H 29/52; B65H 5/36
USPC ..... 271/209, 161; 399/306, 406, 405; 400/642, 633, 630, 619
See application file for complete search history.

(56) References Cited

U.S. PATENT DOCUMENTS 6,503,011 B2 * 1/2003 Kono ..... B41J 13/106 271/188
6,671,490 B2 * 12/2003 Suenaga ..... 399/406
(Continued)

FOREIGN PATENT DOCUMENTS

CN 1550437 A 12/2004
CN 101510060 A 8/2009
(Continued)

OTHER PUBLICATIONS

Machine translation of IDS reference to Saito JP 2009-190809 A, Published Aug. 27, 2009.*
(Continued)

*Primary Examiner* — John Fitzgerald
*Assistant Examiner* — John M Royston
(74) *Attorney, Agent, or Firm* — Sughrue Mion, PLLC

(57) ABSTRACT

A paper transporting device includes a driving roller member, a driven roller member, a first guiding member and a second guiding member. The driving roller member is rotated. The driven roller member is rotated in contact with the driving roller member. The first guiding member is disposed on a driving roller member side, and guides a paper to a contact portion in which the driving roller member and the driven roller member are in contact with each other. The second guiding member is disposed on a driven roller member side, and guides the paper to the contact portion. The second guiding member partially protrudes inward in a radial direction of the driving roller member from an outer peripheral surface of the driving roller member at a downstream side in a paper transporting direction of the contact portion.

17 Claims, 14 Drawing Sheets

(51) Int. Cl.

| | |
|---|---|
| ***B65H 29/52*** | (2006.01) |
| ***B65H 5/36*** | (2006.01) |
| ***B65H 31/02*** | (2006.01) |
| ***B65H 31/20*** | (2006.01) |
| ***G03G 15/00*** | (2006.01) |
| ***B65H 29/70*** | (2006.01) |

(52) U.S. Cl.

CPC ..... *G03G 15/602* (2013.01); *G03G 15/6573* (2013.01); *B65H 5/068* (2013.01); *B65H 2301/33312* (2013.01); *B65H 2301/51214* (2013.01); *B65H 2402/10* (2013.01); *B65H 2402/441* (2013.01); *B65H 2404/132* (2013.01); *B65H 2404/133* (2013.01); *B65H 2404/1316* (2013.01); *B65H 2404/1317* (2013.01); *B65H 2404/1321* (2013.01); *B65H 2404/13171* (2013.01); *B65H 2404/141* (2013.01); *B65H 2404/6942* (2013.01); *B65H 2405/1117* (2013.01); *B65H 2405/11164* (2013.01); *B65H 2405/111646* (2013.01); *B65H 2405/33115* (2013.01); *B65H 2601/251* (2013.01); *B65H 2701/1313* (2013.01); *B65H 2801/06* (2013.01); *B65H 2801/12* (2013.01)

(56) References Cited

U.S. PATENT DOCUMENTS

| | | | | |
|---|---|---|---|---|
| 7,052,008 | B2 | 5/2006 | Mitsuya et al. | |
| 7,267,339 | B2 | 9/2007 | Mitsuya et al. | |
| 7,419,156 | B2 * | 9/2008 | Mitsuya et al. | 271/262 |
| 7,429,038 | B2 * | 9/2008 | Ruthenberg et al. | 270/59 |
| 7,954,803 | B2 * | 6/2011 | Kitagawa et al. | 271/9.01 |
| 7,954,806 | B2 | 6/2011 | Saito | |
| 8,041,283 | B2 * | 10/2011 | Murai | 399/367 |
| 8,267,402 | B2 | 9/2012 | Saito | |
| 2003/0160385 | A1 | 8/2003 | Furusawa | |
| 2004/0245706 | A1 | 12/2004 | Mitsuya et al. | |
| 2006/0082048 | A1 | 4/2006 | Mitsuya et al. | |
| 2006/0186594 | A1 | 8/2006 | Mitsuya et al. | |
| 2007/0065201 | A1 | 3/2007 | Fujiwara et al. | |
| 2007/0145674 | A1 | 6/2007 | Saito | |
| 2008/0012196 | A1 | 1/2008 | Ruthenberg et al. | |
| 2008/0273908 | A1 * | 11/2008 | Ohkubo et al. | 399/405 |
| 2009/0200733 | A1 | 8/2009 | Saito | |
| 2010/0032895 | A1 * | 2/2010 | Sahara et al. | 271/314 |
| 2011/0206435 | A1 | 8/2011 | Saito | |

FOREIGN PATENT DOCUMENTS

| | | | | |
|---|---|---|---|---|
| JP | 2911655 | B2 | | 6/1990 |
| JP | 05-000548 | A | | 1/1993 |
| JP | 05-294530 | A | | 9/1993 |
| JP | 2002-362820 | A | | 12/2002 |
| JP | 3539119 | B2 | | 7/2004 |
| JP | 2005-263335 | A | | 9/2005 |
| JP | 3850590 | B2 | | 11/2006 |
| JP | 2007-84182 | A | | 4/2007 |
| JP | 3962605 | B2 | | 5/2007 |
| JP | 2007-176690 | A | | 7/2007 |
| JP | 2007223044 | A | * | 9/2007 |
| JP | 2009-190809 | A | | 8/2009 |

OTHER PUBLICATIONS

Machine translation of IDS reference to Fujiwara et al. JP 2007-084182 A, Published Apr. 5, 2007.*

Office Action dated Dec. 17, 2013 issued by the Japanese Patent Office in counterpart Japanese Patent Application No. 2010-053806.

Office Action dated Apr. 30, 2014 issued by the State Intellectual Property Office of P.R. China in corresponding Chinese Application No. 201010519010.8.

Office Action, Issued by the State Intellectual Property Office of P.R. China, Dated Dec. 12, 2014, in counterpart Chinese Application No. 201010519010.8.

* cited by examiner

PAPER TRANSPORTING DEVICE, IMAGE FORMING APPARATUS, IMAGE READING DEVICE AND POST-PROCESSING DEVICE

CROSS-REFERENCE TO RELATED APPLICATION

This application is based on and claims priority under 35 USC 119 from Japanese Patent Application No. 2010-053806 filed on Mar. 10, 2010.

BACKGROUND

1. Technical Field

The present invention relates to a paper transporting device and an image forming apparatus using the paper transporting device, an image reading device and a post-processing device.

2. Related Art

In the image forming apparatus, the image reading device, or the post-processing device, there is used a paper transporting device to transport a recording paper having an image formed thereon, a document from which an image is read, or a recording paper subjected to a post-processing.

SUMMARY

According to an aspect of the invention, a paper transporting device includes a driving roller member, a driven roller member, a first guiding member and a second guiding member. The driving roller member is rotated. The driven roller member is rotated in contact with the driving roller member. The first guiding member is disposed on a driving roller member side, and guides a paper to a contact portion in which the driving roller member and the driven roller member are in contact with each other. The second guiding member is disposed on a driven roller member side, and guides the paper to the contact portion. The second guiding member partially protrudes inward in a radial direction of the driving roller member from an outer peripheral surface of the driving roller member at a downstream side in a paper transporting direction of the contact portion.

BRIEF DESCRIPTION OF THE DRAWINGS

Exemplary embodiments of the invention will be described in detail based on the following figures, wherein.

DETAILED DESCRIPTION

Embodiments according to the invention will be described below with reference to the drawings.

Figure 2:
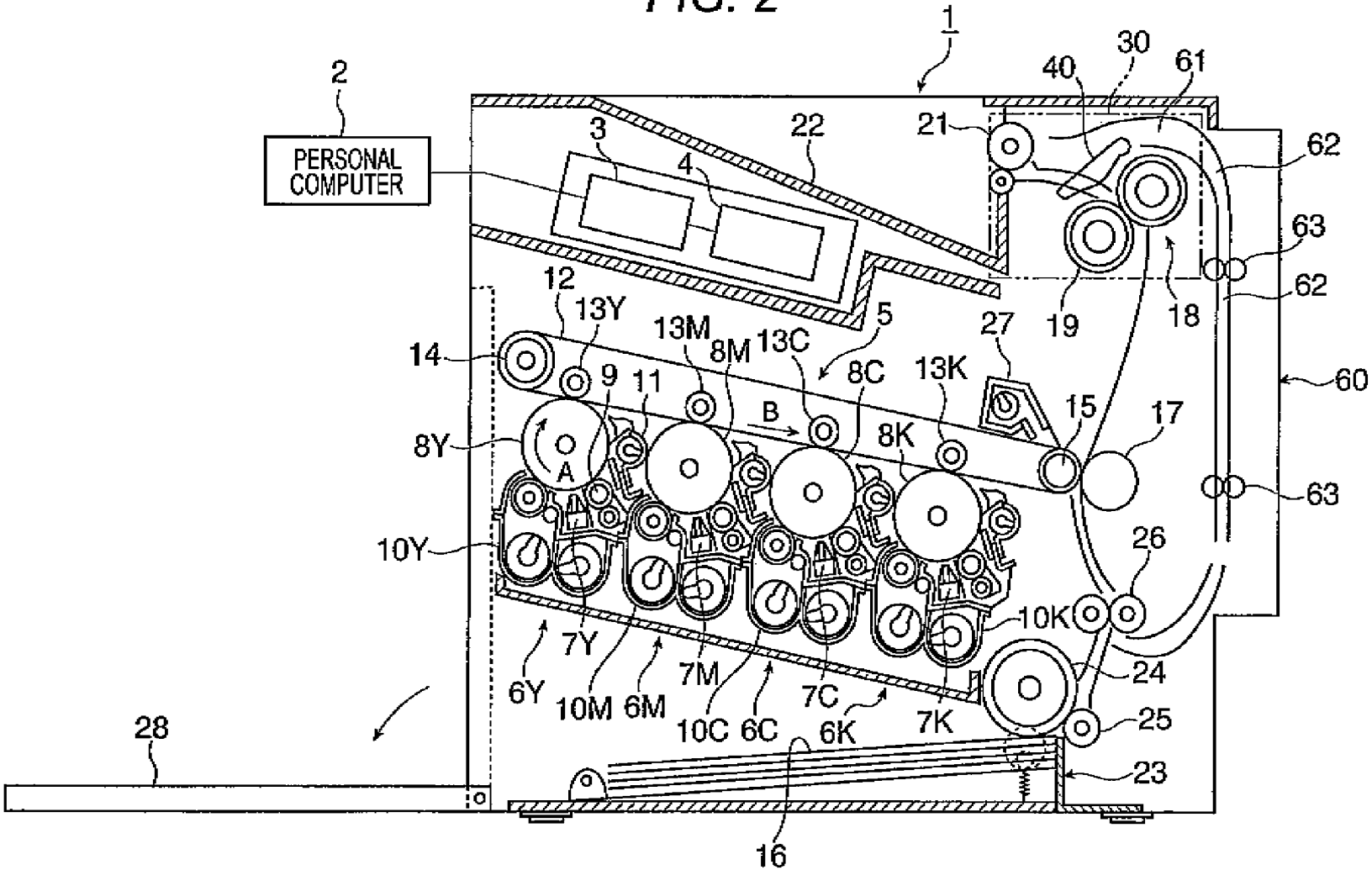
FIG. 2 is a view showing a structure of the color printer of the tandem type which serves as the image forming apparatus applying the paper transporting device according to the embodiment of the invention.
Figure 3:
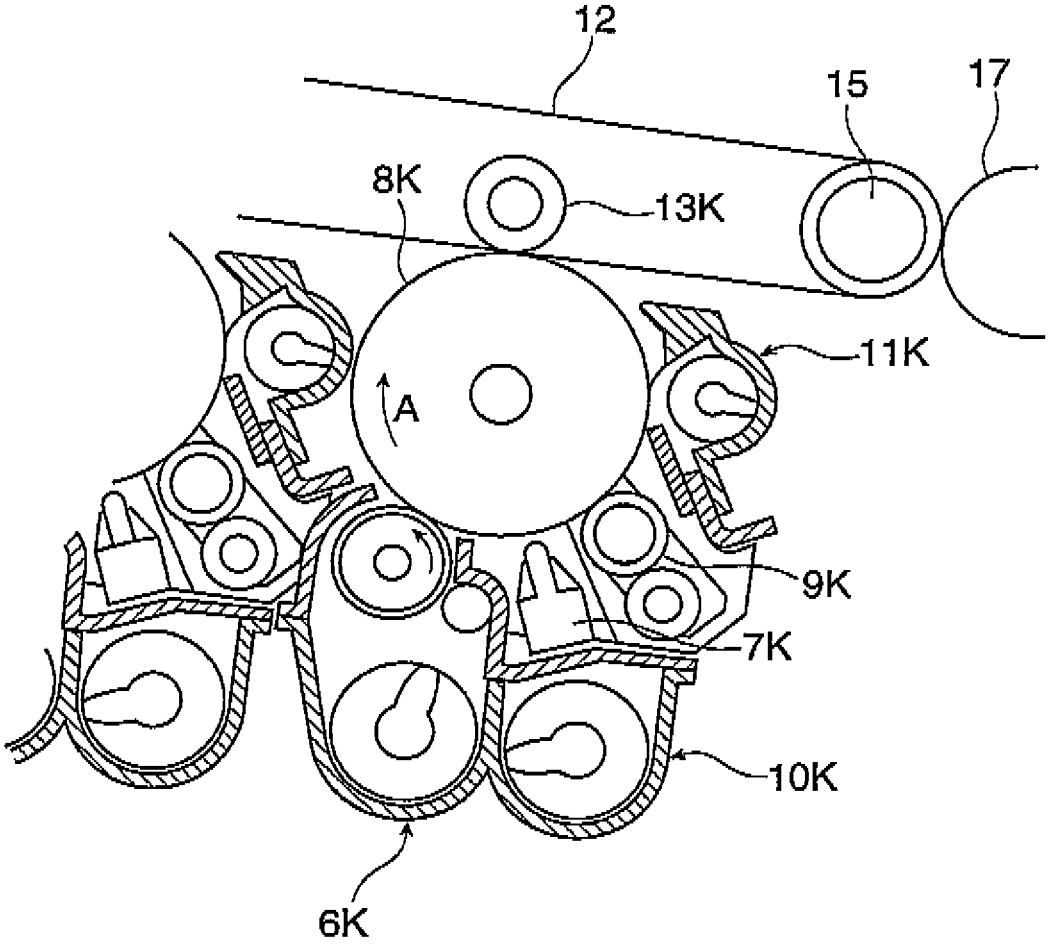
FIG. 3 is a view showing a structure of an image forming portion in the color printer of the tandem type which serves as the image forming apparatus applying the paper transporting device according to the embodiment of the invention.

FIG. 2 is a view showing a structure of a color printer of a tandem type which serves as an image forming apparatus applying a paper transporting device according to an embodiment of the invention. Moreover, FIG. 3 is a view showing a structure of an image forming portion of the color printer.

As shown in FIG. 2, the color printer serves to output a full color or monochrome image depending on image data output from a personal computer or an image reading device which is not shown or image data transferred through a telephone line or a LAN.

As shown in FIG. 2, a color printer body 1 includes an image processing portion 3 for carrying out a predetermined image processing such as a shading correction, a positional shift correction, a lightness/color space conversion, a gamma correction, a frame erasure or a color/movement edit over image data transferred from a personal computer (PC) 2 or an image reading device (not shown) if necessary, and a control portion 4 for controlling an operation of the whole color printer.

The image data subjected to the predetermined image processing by the image processing portion 3 as described above are also converted into image data having four colors of yellow (Y), magenta (M), cyan (C) and black (K) by the image processing portion 3 and are output as a full color image or a monochrome image by an image output portion 5 provided in the color printer body 1 as will be described below.

The image data converted into the image data having the four colors of the yellow (Y), the magenta (M), the cyan (C) and the black (K) by the image processing portion 3 are transmitted to image exposing devices 7Y, 7M, 7C and 7K of image forming units 6Y, 6M, 6C and 6K for the colors of the yellow (Y), the magenta (M), the cyan (C) and the black (K).

In the image exposing devices 7Y, 7M, 7C and 7K, an image is exposed by a light emitted from an LED light emitting device array depending on the image data on a corresponding one of the colors.

As shown in FIG. 2, in the color printer body 1, the four image forming units (image forming portions) 6Y, 6M, 6C and 6K for the yellow (Y), the magenta (M), the cyan (C) and the black (K) are disposed in parallel at a certain interval in a state in which they are tilted by a predetermined angle (for example, approximately 10 degrees) to a horizontal direction such that the image forming unit 6Y for the yellow (Y) to be a first color is relatively high and the image forming unit 6K for the black (K) to be a final color is relatively low. As a matter of course, tilt angles of the image forming units 6Y, 6M, 6C and 6K are not restricted to approximately 10 degrees but may be greater or smaller.

By disposing the four image forming units 6Y, 6M, 6C and 6K for the yellow (Y), the magenta (M), the cyan (C) and the black (K) in a tilting state at a predetermined angle, thus, it is possible to set a distance among the image forming units 6Y, 6M, 6C and 6K to be shorter as compared with the case in which the four image forming units 6Y, 6M, 6C and 6K are provided horizontally. Consequently, it is possible to decrease a width of the color printer body 1, thereby reducing a size still more.

The four image forming units 6Y, 6M, 6C and 6K basically have the same structures except for a color of an image to be formed, and are roughly constituted by a photosensitive drum 8 serving as an image holding member to be rotated and driven at a predetermined speed in a direction of an arrow A by driving means which is not shown, a charging roll 9 for primary charging which uniformly charges a surface of the photosensitive drum 8, the image exposing device 7 including an LED print head for exposing a corresponding image to a predetermined color to form an electrostatic latent image on the surface of the photosensitive drum 8, a developing device 10 for developing the electrostatic latent image formed on the photosensitive drum 8 with a toner having a predetermined color, and a cleaning device 11 for cleaning the surface of the photosensitive drum 8 as shown in FIGS. 2 and 3.

The photosensitive drum 8 to be used is formed like a drum having a diameter of approximately 30 mm and has a surface coated with a photosensitive layer constituted by an organic photoconductor (OPC), for example, and is rotated and driven at a predetermined speed in the direction of the arrow A by means of a driving motor which is not shown.

For the charging roll 9, moreover, there is used a roll-shaped charger obtained by coating a surface of a core bar with a conductive layer constituted by a synthetic resin or a synthetic rubber and having an electric resistance regulated, for example, and a predetermined charging bias is applied to the core bar of the charging roll 9.

The image exposing device 7 is individually disposed for each of the four image forming units 6Y, 6M, 6C and 6K as shown in FIG. 2, and the image exposing device 7 provided in each of the image forming units 6Y, 6M, 6C and 6K which is to be used includes an LED light emitting device array in which LED light emitting devices are disposed rectilinearly in an axial direction of the photosensitive drum 8 at a predetermined pitch (for example, 600 dpi to 1200 dpi) and a rod lens array in which an image of a light emitted from each of the LED light emitting devices of the LED light emitting device array is formed like a spot on the photosensitive drum 8. Moreover, the image exposing device 7 is constituted to scan and expose an image onto the photosensitive drum 8 from below as shown in FIGS. 2 and 3.

In the case in which the image exposing device 7 constituted by the LED light emitting device array is used, a size of the image exposing device can be reduced considerably, which is desirable. However, the image exposing device 7 is not restricted to the LED light emitting device array but it is also possible to use an image exposing device which deflects and scans a laser beam in the axial direction of the photosensitive drum 8. In this case, the single image exposing device 7 is disposed for the four image forming units 6Y, 6M, 6C and 6K.

Image data on corresponding colors are sequentially output from the image processing portion 3 to the image exposing devices 7Y, 7M, 7C and 7K provided individually in the image forming units 6Y, 6M, 6C and 6K for the respective colors of the yellow (Y), the magenta (M), the cyan (C) and the black (K) as described above, and luminous fluxes emitted depending on the image data from the image exposing devices 7Y, 7M, 7C and 7K are scanned and exposed onto surfaces of photosensitive drums 8Y, 8M, 8C and 8K corresponding thereto so that electrostatic latent images depending on the image data are formed. The electrostatic latent images formed on the photosensitive drums 8Y, 8M, 8C and 8K are developed as toner images for the respective colors of the yellow (Y), the magenta (M), the cyan (C) and the black (K) by developing devices 10Y, 10M, 10C and 10K, respectively.

The toner images for the respective colors of the yellow (Y), the magenta (M), the cyan (C) and the black (K) formed sequentially on the photosensitive drums 8Y, 8M, 8C and 8K of the image forming units 6Y, 6M, 6C and 6K are primarily transferred sequentially in a multiple way by means of four primary transfer rolls 13Y, 13M, 13C and 13K onto an intermediate transfer belt 12 serving as a non-end belt-shaped intermediate transfer member which is disposed in a tilting state above the image forming units 6Y, 6M, 6C and 6K.

The intermediate transfer belt 12 is a non-end belt-shaped member which is laid with a tension by means of a plurality of rolls, and is disposed in a tilting state to a horizontal direction in such a manner that a lower side running region of the belt-shaped member has downstream and upstream sides in a running direction which are relatively low and high, respectively.

In other words, as shown in FIG. 2, the intermediate transfer belt 12 is laid with a certain tension between a driving roll 15 having a function for a back support roll of a secondary transfer portion and a driven roll 14, and is circulated and driven at a predetermined speed in a direction of an arrow B by means of the driving roll 15 to be rotated and driven by a driving motor (not shown) which is excellent in a constant speed stability. There is used the intermediate transfer belt 12 which is formed like a non-end belt by a synthetic resin film such as polyimide or polyamide-imide which has a flexibility, for example. The intermediate transfer belt 12 is disposed in contact with the photosensitive drums 8Y, 8M, 8C and 8K of the image forming units 6Y, 6M, 6C and 6K in the low side running region.

As shown in FIG. 2, moreover, a secondary transfer roll 17 to be secondary transfer means is disposed on the intermediate transfer belt 12 in contact with a surface of the intermediate transfer belt 12 laid with the tension by the driving roll 15. The secondary transfer roll 17 is provided on an end at a lower position side in the running region of the intermediate transfer belt 12 and serves to secondarily transfer, onto a recording medium 16, the toner image transferred primarily onto the intermediate transfer belt 12.

The toner images for the respective colors of the yellow (Y), the magenta (M), the cyan (C) and the black (K) transferred onto the intermediate transfer belt 12 in the multiple way are secondarily transferred onto the recording paper 16 to be a paper by means of the secondary transfer roll 17 coming in contact with the driving roll 15 through the intermediate transfer belt 12, and the recording paper 16 having the toner images for the respective colors transferred thereonto is transported to a fixing device 18 positioned above in a vertical direction as shown in FIG. 2. The secondary transfer roll 17 is provided in pressure contact with a side of the driving roll 15 through the intermediate transfer belt 12, and serves to secondarily transfer the toner images for the respective colors in a lump onto the recording paper 16 transported upward in the vertical direction.

For example, the secondary transfer roll 17 to be used is obtained by coating, in a predetermined thickness, an outer periphery of a core bar formed of a metal such as stainless with an elastic layer constituted by a conductive elastic member such as a synthetic rubber material to which a conductive agent is added.

The recording paper 16 having the toner images for the respective colors transferred thereonto is subjected to a fixing treatment by heat and pressure through a heating roll 19 and a pressurizing belt (or a pressurizing roll) 20 in the fixing device 18 serving as fixing means, and is then discharged onto a discharging tray 22 provided on an upper end of the printer body 1 by means of a discharging roll 21 in a state in which an image surface is turned downward.

Figure 4:
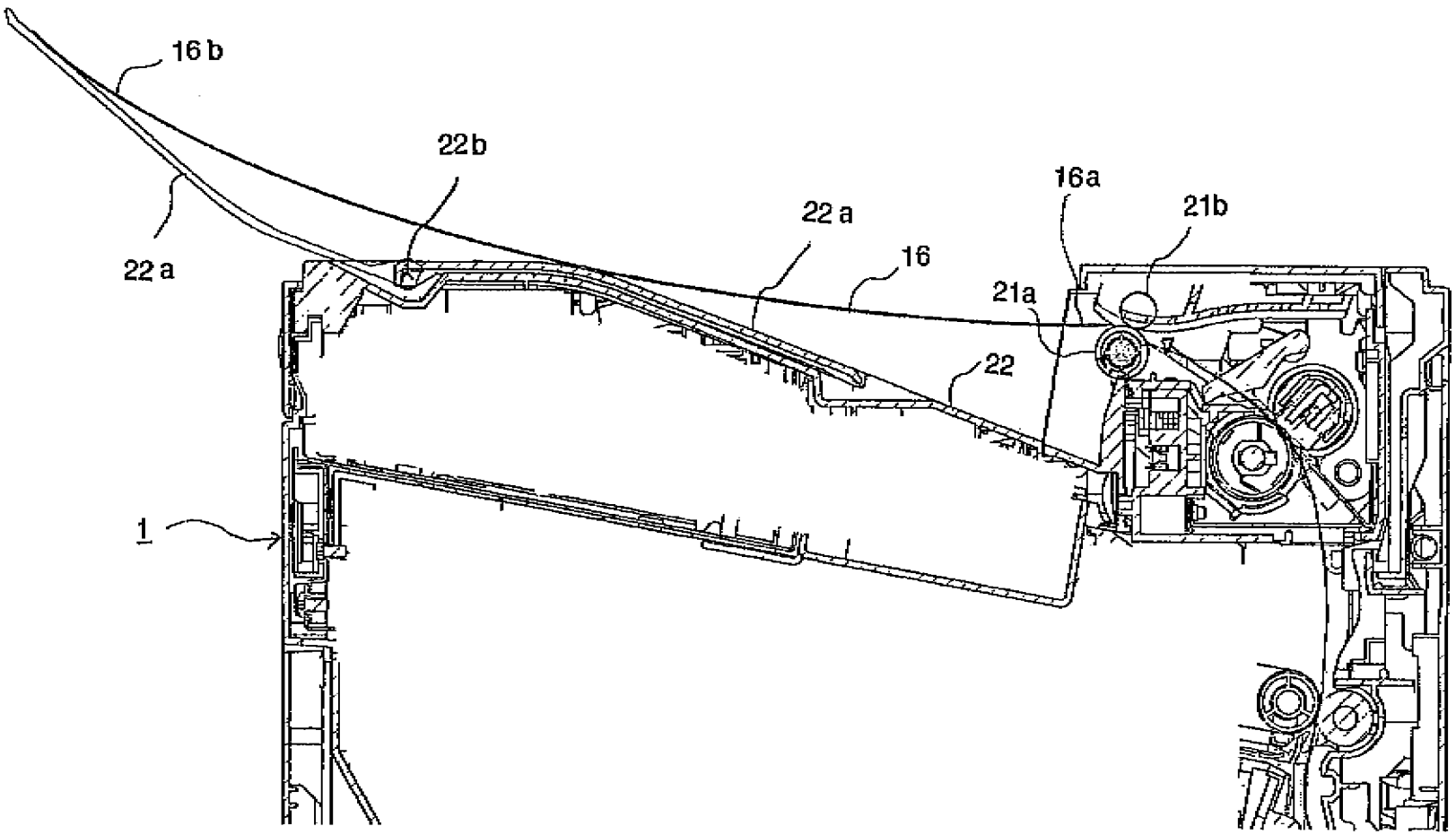
FIG. 4 is a view showing a structure of a main part in the color printer of the tandem type which serves as the image forming apparatus applying the paper transporting device according to the embodiment of the invention.

In the embodiment, the discharging tray 22 is also formed to have a size reduced with the decrease in the size of the printer body 1, and is of a folding type in such a manner that the recording paper 16 having a relatively great length in the discharging direction and a large size can be discharged. As shown in FIG. 4, the discharging tray 22 can also discharge the recording paper 16 having a large size by rotating a folded auxiliary tray 22*a* around a fulcrum 22*b* and unfolding the auxiliary tray 22*a* from the discharging tray 22.

As shown in FIG. 2, the recording papers 16 which are formed by a predetermined material in a predetermined size are fed from a paper feeding tray 23 disposed in a bottom part of the printer body 1 in a state in which they are separated one by one by means of a paper feeding roll 24 and a paper separating roll 25, and are once transported to a resist roll 26 and are stopped. Then, the recording paper 16 supplied from the paper feeding tray 23 is fed to a secondary transfer position of the intermediate transfer belt 12 by means of the resist roll 26 rotated in a predetermined timing. For the recording paper 16, it is possible to supply a thick paper such as a coat paper subjected to a coating treatment over a surface or both the surface and a back face and an OHP sheet in addition to a plain paper, and a photographic image is also output to the recording paper 16 constituted by the coat paper.

In that case, for example, the recording paper 16 is fed and transported with a central part in a direction crossing a paper feeding direction set to be a reference and the toner image is transferred and fixed from the intermediate transfer belt 12, and similarly, is discharged onto the discharging tray 22 with the central part in the direction crossing the paper feeding direction set to be the reference. The invention is not always restricted thereto but it is also possible to employ a structure in which the recording paper 16 is fed and transported with one of ends in the direction crossing the paper feeding direction set to be the reference, for example.

As shown in FIGS. 2 and 3, a residual toner is removed by the cleaning device 11 from the surface of the photosensitive drum 8 subjected to the primary transferring step for the toner image to prepare for a next image forming step. As shown in FIG. 2, moreover, a residual toner is removed from the surface of the intermediate transfer belt 12 subjected to the secondary transferring step for the toner image by means of a belt cleaning device 27 provided in the vicinity on a downstream side of the driving roll 15 to prepare for a next image forming step.

In the embodiment, moreover, an image can be formed on both a surface and a back face of the recording paper 16 in addition to only the surface of the recording paper 16.

In the embodiment, as shown in FIG. 2, there is employed a structure in which a double-sided paper transporting unit 60 can be freely attached/removed, as an option device, to/from the printer body 1 or is of another device type which is previously attached to the printer body 1.

As shown in FIG. 2, the double-sided paper transporting unit 60 does not discharge the recording paper 16 having an image formed on one of sides by a fixing unit 30 onto the discharging tray 22 by means of the discharging roll 21 but a rotating direction of the discharging roll 21 is inverted and switching into a double-sided paper transporting path 61 provided above a fixing device 18 is carried out by means of a switching gate member 40 for switching a transporting direction of the recording paper 16 while the rear end in the discharging direction of the recording paper 16 is held by the discharging roll 21.

As shown in FIG. 2, moreover, the double-sided paper transporting unit 60 includes a double-sided paper transporting path 62 communicating with the double-sided paper transporting path 61, and a transporting roll 63 for transporting the recording paper 16 to a resist roll 26 is provided in the double-sided paper transporting path 62.

The recording paper 16 transported to the resist roll 26 by the double-sided paper transporting unit 60 is transported to a secondary transfer position of an intermediate transfer belt 12 by means of the resist roll 26 with a surface and a back face inverted, an image is transferred and fixed onto the back face of the recording paper 16 and the recording paper 16 is then discharged onto the discharging tray 22 provided in an upper part of the printer body 1 by means of the discharging roll 21.

Figure 1:
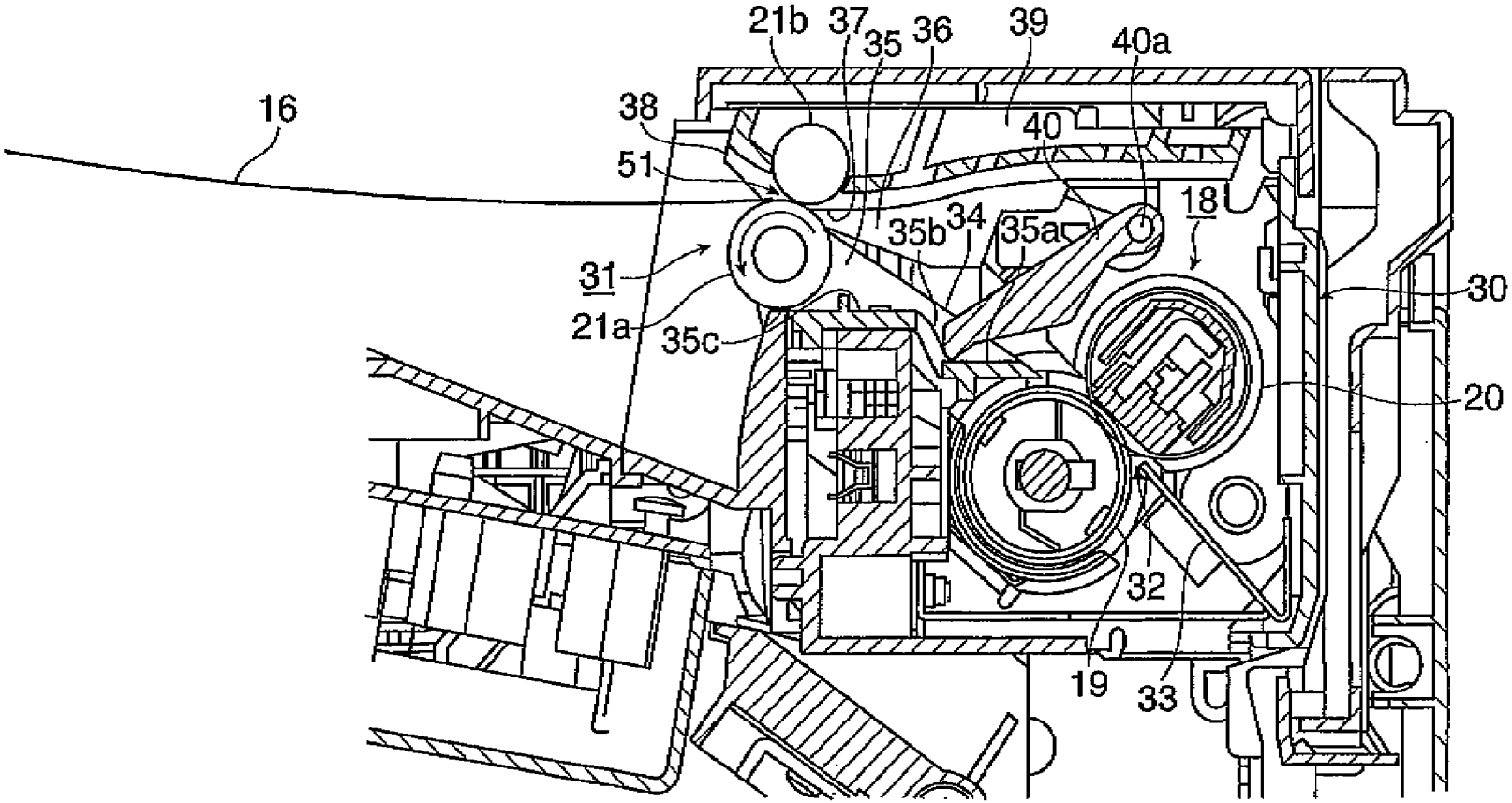
FIG. 1 is a view showing a structure of a main part in a color printer of a tandem type which serves as an image forming apparatus applying a paper transporting device according to an embodiment of the invention.

FIG. 1 is a view showing a sectional structure of a fixing unit applying the paper transporting device according to the first embodiment of the invention.

Figure 5:
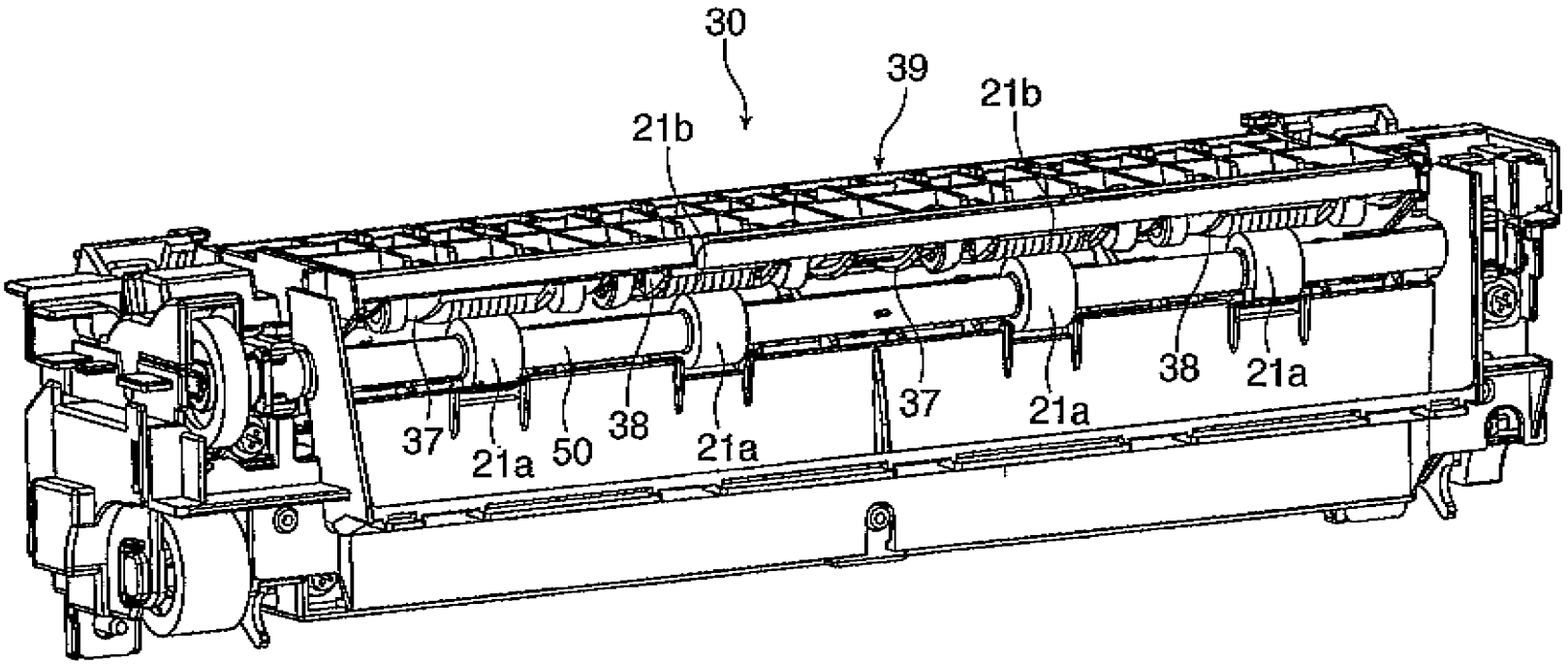
FIG. 5 is a perspective view showing an appearance of the paper transporting device according to the embodiment of the invention.

As shown in FIG. 5, a fixing unit 30 is formed as an independent unit and is constituted removably from the printer body 1. As shown in FIG. 1, the discharging roll 21 and a paper discharging device 31 as an example of a paper transporting device according to the embodiment are attached to the fixing unit 30 in addition to the fixing device 18. The discharging roll 21 serves to discharge, onto the discharging tray 22, the recording paper 16 subjected to the fixing treatment by the fixing device 18.

The paper discharging device 31 includes a pair of discharging rollers 21 and first and second guiding members for guiding the recording paper 16 to a contact portion (a nip portion) of the discharging rollers 21. As shown in FIG. 5, the discharging roller 21 is constituted by a driving roller 21*a* attached to a rotating shaft 50 to be rotated and driven by means of a driving motor (not shown) and a driven roller 21*b* to be driven and rotated in contact with the driving roller 21*a*. The driving roller 21*a* is constituted by a roller formed by a rubber or a synthetic resin, for example. Four driving rollers 21*a* are attached in an axial direction of the rotating shaft 50. The printer has such a structure that the recording paper 16 is fed and transported by setting, as a reference, a central part in a direction crossing a transporting direction of the recording paper 16 to form an image on the surface of the recording paper 16. The four driving rollers 21*a* are attached in a fixing state to a symmetrical position in the axial direction of the rotating shaft 50. Two driving rollers 21*a* may be attached.

Two of the four driving rollers 21*a* which are disposed on an inside are provided corresponding to a slightly smaller interval than a width (for example, approximately 70 mm) of the recording paper 16 having a minimum size on which an image is to be formed by the printer. Moreover, two of them which are disposed on an outside are provided corresponding to a slightly smaller interval than a width of the recording paper 16 having a maximum size on which an image is to be formed by the printer.

Figure 6:
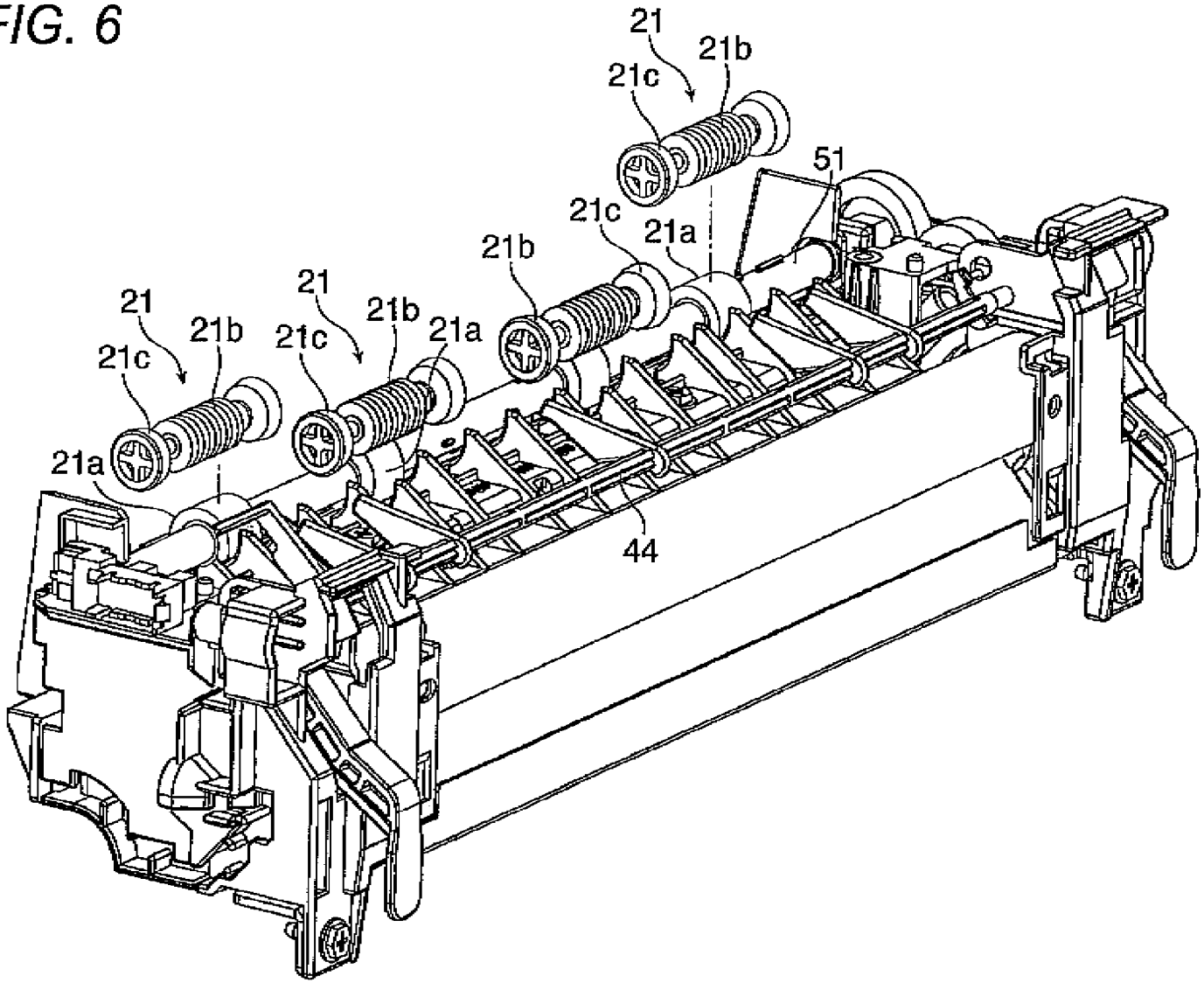
FIG. 6 is a perspective view showing the appearance of the paper transporting device according to the embodiment of the invention.

In addition, the driven roller 21*b* coming in contact with a surface of the driving roller 21*a* to form a transporting nip portion 51 of the recording paper 16 between the driven roller 21*b* and the driving roller 21*a* is constituted by a first driven roller 21*b* formed to take a shape in which a plurality of divided rollers is linked in an axial direction by a synthetic resin, for example, and a second driven roller 21*e* disposed coaxially on each of both ends in the axial direction of the first driven roller 21*b*, formed to take a larger size than an outside diameter of the first driven roller 21*b* and driven and rotated simultaneously with the first driven roller 21*b* as shown in FIG. 6. The first driven roller 21*b* is formed to take a greater length in the axial direction than that of the driving roller 21*a*. Moreover, the second driven roller 21*c* is formed to take a taper shape in such a manner that the outside diameter is reduced inward in the axial direction.

As shown in FIG. 2, the recording paper 16 is transported to the fixing unit 30. A full color toner image is secondarily transferred to the recording paper 16 in a secondary transfer position of the intermediate transfer belt 12. As shown in FIG. 1, a plate-shaped inlet side guiding member 33 is provided in an inlet portion of the fixing device 18. The inlet side guiding member 33 is disposed with a tilt and serves to guide the recording paper 16 to a fixing nip portion 32 with which the heating roll 19 and the pressurizing belt 20 come in pressure contact.

Figure 7:
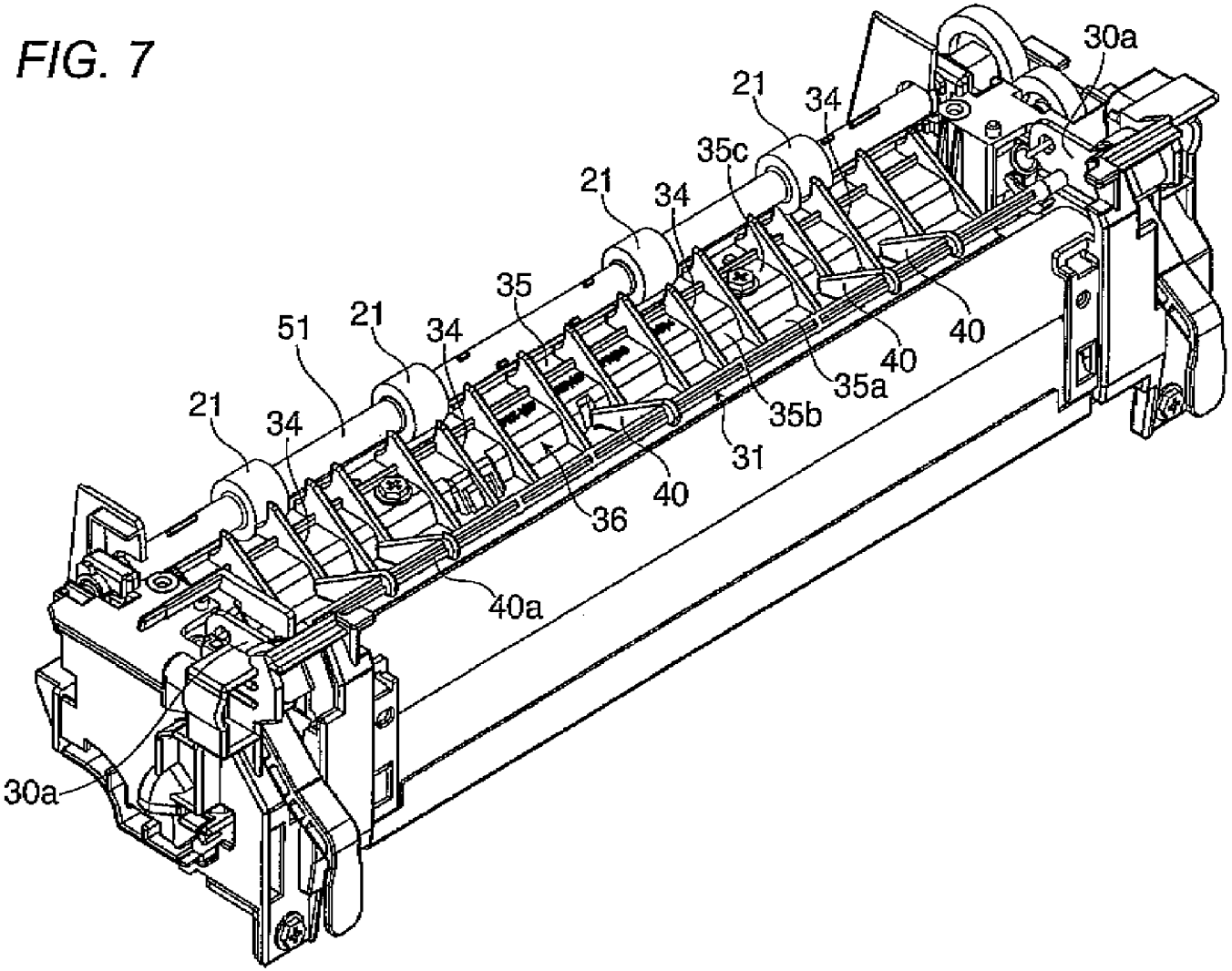
FIG. 7 is a perspective view showing the appearance of the paper transporting device according to the embodiment of the invention.

As shown in FIG. 1, in an outlet portion positioned on a downstream side in a recording paper discharging direction of the fixing device 18, moreover, an outlet side lower guiding member 35 is provided on the heating roll 19 side of the fixing device 18. The outlet side lower guiding member 35 includes a plurality of convex members 34 for guiding the recording paper 16 passing through the fixing nip portion 32 to the discharging roller 21. The outlet side lower guiding member 35 is provided as a first guiding member with a first plate portion 35*a*, a tilted portion 35*b* and a second plate portion 35*c* which are formed integrally by a heat-resistant synthetic resin, for example. As shown in FIGS. 1 and 5, the first plate portion 35*a* is disposed on the fixing nip portion 32 side of the fixing device 18, the tilted portion 35*b* is provided in a tilting state toward the downstream side in the recording paper transporting direction of the first plate portion 35*a*, and the second plate portion 35*c* is disposed on the downstream side in the recording paper transporting direction of the tilted portion 35*b*. As shown in FIG. 7, the convex members 34 formed to take an almost triangular shape at a side surface are disposed on a surface of the outlet side lower guiding member 35. They are provided at a predetermined interval in the direction crossing the recording paper transporting direction in a state in which they are protruded to a discharging transporting path 36 side of the recording paper 16 from the first plate portion 35*a*, the tilted portion 35*b* and the second plate portion 35*c*.

Furthermore, an outlet side upper guiding member 38 serving as a second guiding member including a plurality of convex members 37 is provided in the same manner as the outlet side lower guiding member 35 so as to form a discharging transporting path 36 between the outlet side upper guiding member 38 and the outlet side lower guiding member 35 at the driven roller 21*b* side of the discharging roller 21 (an upper side in FIG. 1) as shown in FIG. 1.

As shown in FIGS. 1 and 4, the outlet side upper guiding member 38 is formed integrally with a lower surface of an upper cover 39 for covering the upper end face of the fixing unit 30. The upper cover 39 can be freely opened/closed or attached/removed to/from the fixing unit 30 in such a manner that the discharging transporting path 36 for the recording paper 16 is exposed to an outside to enable a removal of the recording paper 16 with which the discharging transporting path 36 is jammed as shown in FIG. 7.

The recording paper 16 passing through the fixing nip portion 32 of the fixing device 18 is guided to the discharging roll 21 through the discharging transporting path 36 as shown in FIG. 1. In that case, a lower surface of the recording paper 16 is guided by means of the convex members 34 of the outlet side lower guiding member 35 as shown in FIGS. 1 and 7, and furthermore, an upper surface thereof is guided by means of the convex members 37 of the outlet side upper guiding member 38 as shown in FIG. 1. Moreover, the discharging transporting path 36 is formed in such a manner that a width of a passage is gradually reduced toward the discharging roll 21 side, and an end on the discharging roll 21 side is disposed to be shifted toward a side of a lower discharging roll 21*a* which has a relatively larger diameter and is to be rotated and driven in a pair of upper and lower discharging rolls 21*a* and 21*b* (21*c*) as shown in FIG. 1.

In addition, a switching gate member 40 is disposed rockably around a spindle 40*a* in an outlet portion at a downstream side in the paper transporting direction of the fixing nip portion 32 of the fixing device 18 as shown in FIG. 1. The switching gate member 40 also serves as a detecting member for detecting a discharge of the recording paper 16 fixed by the fixing device 18.

In the embodiment, as shown in FIG. 1, there is provided the outlet side upper guiding member 38 to be a member disposed on the driven roller member side and serving to guide the paper to the nip portion and to be a second guiding member formed to be partially protruded inward in a radial direction of the driving roller member from an outer peripheral surface of the driving roller member at the downstream side in the paper transporting direction of the contact portion.

In other words, in the embodiment, the outlet side upper guiding member 38 serving as the second guiding member is provided on the driven roller 21*b* side in the discharging roller 21 as shown in FIG. 1. The outlet side upper guiding member 38 includes a plurality of convex members 37 provided on a lower surface of the outlet side upper guiding member 38 in the same manner as the outlet side lower guiding member 35 shown in FIG. 7 in order to reduce a contact area with the recording paper 16.

Figure 8:
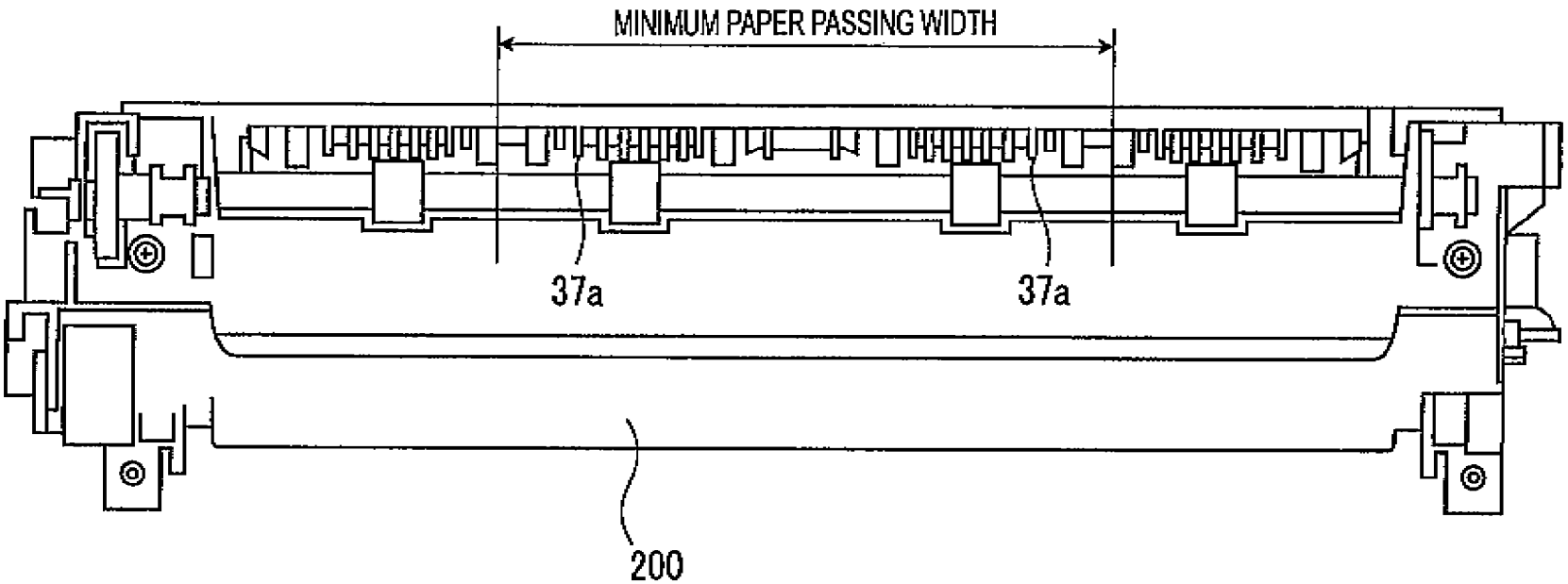
FIG. 8 is a perspective view showing the appearance of the paper transporting device according to the embodiment of the invention.
Figure 9:
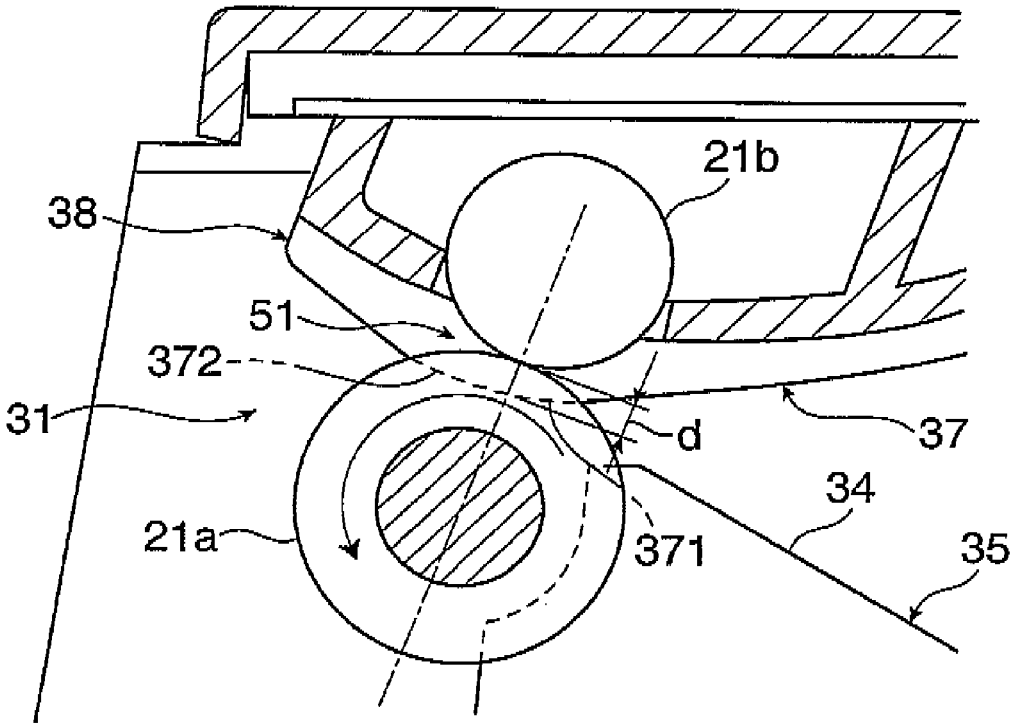
FIG. 9 is an enlarged sectional view showing a main part of the paper transporting device according to the embodiment of the invention.

In the convex members 37, two convex members 37*a* disposed adjacently to each other at an outside in the axial direction of the two driving rollers 21*a* provided on an inside as shown in FIG. 8 are formed in such a manner that a part positioned on upstream and downstream sides of the nip portion of the discharging roller 21 and at least a downstream side in the paper discharging direction is protruded inward in the radial direction from an outer peripheral surface of the driving roller 21*a* as shown in FIG. 9. A frame 200 is disposed to be detachable to a frame of the color printer body 1 (which is not shown). The driving roller 21*a* and the driven roller 21*b* are supported by the frame 200 through a driving shaft and the like.

Further description will be given. The two convex members 37*a* disposed adjacently to each other at the outside in the axial direction of the two driving rollers 21*a* provided on an inside are formed in such a manner that a portion 371 positioned on the upstream side in the paper discharging direction by a predetermined distance from the nip portion 51 is slightly protruded inward in the radial direction (downward in FIG. 9) over the outer periphery of the driving roller 21*a* at an upstream side of the nip portion 51 in the discharging roller 21 and a lower end of the convex member 37 is not placed in the same position as the nip portion 51 but is protruded by a slight distance "d" toward the driving roller 21*a* side from the nip portion 51 also in the nip portion 51 as shown in FIG. 9.

Figure 10:
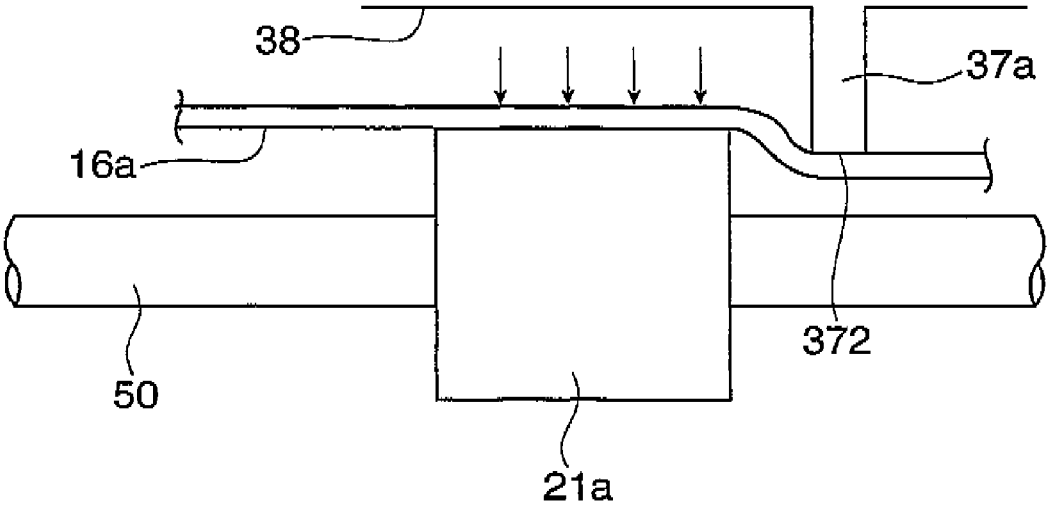
FIG. 10 is an explanatory view showing an action of the paper transporting device according to the embodiment of the invention.

In addition, the two convex members 37*a* are formed in such a manner that a portion 372 positioned on the downstream side in the paper discharging direction by a predetermined distance from the nip portion 51 is protruded toward the driving roller 21*a* side (downward in FIG. 9) by a predetermined distance (for example, approximately 1 mm) at the downstream side of the nip portion 51 in the discharging roller 21 as shown in FIG. 9. The distance is not restricted to be approximately 1 mm but may be properly set within a range of 0.5 to 1.5 mm, for example. As a result, the recording paper 16 discharged by the discharging roller 21 is transported to be curved inward in the radial direction over the outer periphery of the driving roller 21*a* in an adjacent position to the outside in the axial direction of the driving roller 21*a* in the discharging roller 21 when passing through the nip portion 51 of the discharging roller 21 and immediately after passing through the nip portion 51 as shown in FIG. 10. Consequently, a pressing force against the surface of the driving roller 21*a* with a deformation through the convex member 37*a* acts on the recording paper 16 immediately after passing through the nip portion 51 of the discharging roller 21, and a transporting force of the driving roller 21*a* also acts on the recording paper 16 immediately after passing through the nip portion 51 of the discharging roller 21 by the pressing force and a transporting force on the surface of the driving roller 21*a* to be rotated and driven. Thus, the recording paper 16 is reliably transported by the driving roller 21*a* of the discharging roller 21 and is discharged to a normal position on the discharging tray 22. The portion 372 of the convex member 37 has a tip surface formed in parallel with the axial direction of the driving roller 21*a* as shown in FIG. 10. Consequently, a contact area of the portion 372 of the convex member 37 to come in contact with a back face of the recording paper 16 can be set to be larger to some degree as compared with the case in which a tip part of the portion 372 of the convex member 37 is formed to take a shape of a knife edge.

In a double-sided image formation, it is possible to prevent a stripe-shaped image defect from being caused by scratching an image on the surface of the recording paper 16 due to a contact with the portion 372 of the convex member 37.

With the structure, in a color printer applying the paper discharging device according to the embodiment, it is possible to prevent the rear end of the recording paper from remaining on the discharging roller, resulting in deterioration in a paper discharging property without complicating the apparatus and increasing a cost in the following manner.

More specifically, in the color printer, toner images having corresponding colors are formed by four image forming units 6Y, 6M, 6C and 6K for yellow (Y), magenta (M), cyan (C) and black (K) as shown in FIG. 2. The toner images for the yellow (Y), the magenta (M), the cyan (C) and the black (K) formed by the image forming units 6Y, 6M, 6C and 6K are primarily transferred onto the intermediate transfer belt 12 in a multiple way and are then transferred secondarily onto the recording paper 16 in a lump by means of a secondary transfer roll, and are subjected to a fixing treatment by a fixing device and are thus discharged onto the discharging tray provided in an upper part of the printer body 1 by means of the discharging roller.

In that case, the discharging direction of the discharging roller 21 is set to be upward in such a manner that the downstream side in the discharging direction is turned slightly upward with respect to a horizontal direction in order to reliably discharge the recording paper 16 onto the discharging tray 22 provided in the upper part of the printer body 1 as shown in FIG. 4. For this reason, the discharging roller 21 is disposed in such a manner that the driven roller 21*b* coming in contact with the surface of the driving roller 21*a* having a relatively large diameter comes in contact with a position shifted toward the upstream side in the discharging direction of the recording paper 16 from an upper end of the driving roller 21*a*.

As a result, in a printer applying the conventional paper discharging device, when a rear end 16*a* of the recording paper 16 having a great length in the discharging direction thereof and a relatively large size passes through the nip portion 51 of the discharging roller 21 in the discharge of the recording paper 16 as shown in FIG. 4, a transporting force in the discharging direction which is caused by a nip force of the driving roller 21*a* and the driven roller 21*b* does not act on the recording paper 16, and furthermore, there is brought a state in which braking is applied by a frictional force in a movement of a tip portion 16*b* of the recording paper 16 in contact with the discharging tray 22. Consequently, there is a possibility that the rear end 16*a* of the recording paper 16 might be stopped immediately after passing through the nip portion 51 of the discharging roller 21.

When the rear end 16*a* of the recording paper 16 discharged over the discharging tray 22 is stopped immediately after passing through the nip portion 51 of the discharging roller 21, thus, the tip 16*b* of the recording paper 16 discharged next by the discharging roller 21 pushes the rear end 16*a* of the recording paper 16 stopped immediately after passing through the nip portion 51 of the discharging roller 21 so that the recording paper 16 thus pushed might fall from the discharging tray 22 or might be discharged onto the discharging tray 22 in a state in which a posture is confused in a continuous image formation, resulting in deterioration in the paper discharging property.

On the other hand, in a printer applying the paper discharging device according to the embodiment, also when the recording paper 16 having a great length in the discharging direction of the recording paper 16 and a relatively large size is to be discharged as shown in FIG. 1, the portions 371 and 372 of the convex member 37 provided on the lower surface of the outlet side upper guiding member 38 are protruded inward in the radial direction of the driving roller 21*a* over the outer peripheral surface of the driving roller 21*a* of the discharging roller 21 as shown in FIG. 9 also after the rear end 16*a* of the recording paper 16 passes through the nip portion 51 of the discharging roller 21.

Therefore, the recording paper 16 is deformed to be pressed against the surface of the driving roller 21*a* by the portion 372 of the convex member 37 of the outlet side upper guiding member 38 also after the rear end 16*a* passes through the nip portion 51 of the discharging roller 21 as shown in FIG. 10. Consequently, a transporting force acts, together with the nip force, between the recording paper 16 and the surface of the driving roller 21*a* by the convex member 37 so that the rear end 16*a* of the recording paper 16 is reliably discharged onto the discharging tray 22 by means of the driving roller 21*a*.

In the embodiment, accordingly, the rear end 16*a* of the recording paper 16 discharged onto the discharging tray 22 can be prevented from being stopped in the state brought immediately after passing through the nip portion 51 of the discharging roller 21. Also in the continuous image formation, the tip 16*b* of the recording paper 16 discharged next by the discharging roller 21 can be prevented from pushing the rear end 16*a* of the recording paper 16 stopped immediately after passing through the nip portion 51 of the discharging roller 21. Consequently, the recording paper 16 can be discharged onto the discharging tray 22 in an arranging state. Thus, the paper discharging property can be enhanced.

In the embodiment, moreover, it is sufficient that the shape of a part of the convex member 37 in the outlet side upper guiding member 38 is changed. Therefore, it is possible to prevent the apparatus from being complicated and to avoid an increase in a cost.

Figure 11:
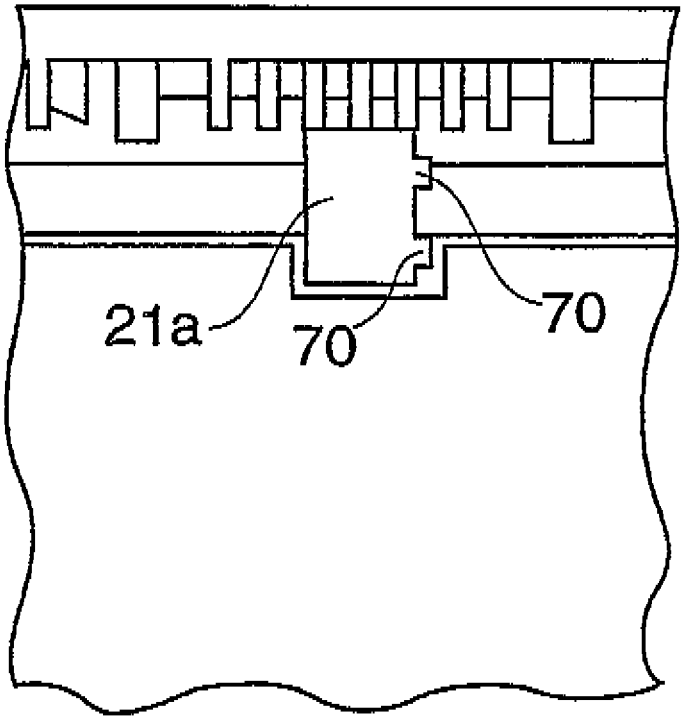
FIG. 11 is a view showing a structure of a main part in a color printer of a tandem type which serves as an image forming apparatus applying a paper transporting device according to other embodiment of the invention.

FIG. 11 shows other embodiment according to the invention. Description will be given by attaching the same reference numerals to the same portions as those in the embodiment described above. In the other embodiment, a driving roller member has such a structure that a plurality of convex portions protruded outward in an axial direction is provided in an outer peripheral direction at an end facing a second guiding member formed to be partially protruded inward in a radial direction from an outer peripheral surface of the driving roller member.

More specifically, in the other embodiment, a shape of a driving roller 21*a* is different from that of the embodiment and the driving roller 21*a* does not take a cylindrical shape but a plurality of convex portions 70 protruded outward in the axial direction from one of ends in the axial direction is uniformly disposed in a circumferential direction of the driving roller 21*a* as shown in FIG. 11.

The convex portion 70 of the driving roller 21*a* has such a structure as to exhibit a function for causing a rear end edge portion of a recording paper 16 to come in contact with an end face in a circumferential direction of the convex portion 70 and energizing and kicking out the rear end edge portion of the recording paper 16 in a tangential direction of the driving roller 21*a* by means of the convex portion 70 of the driving roller 21*a* to be rotated and driven when discharging the recording paper 16, thereby enhancing a discharging property of the recording paper 16.

Since the other structures and functions are the same as those of the embodiment, description thereof will be omitted.

Figure 12:
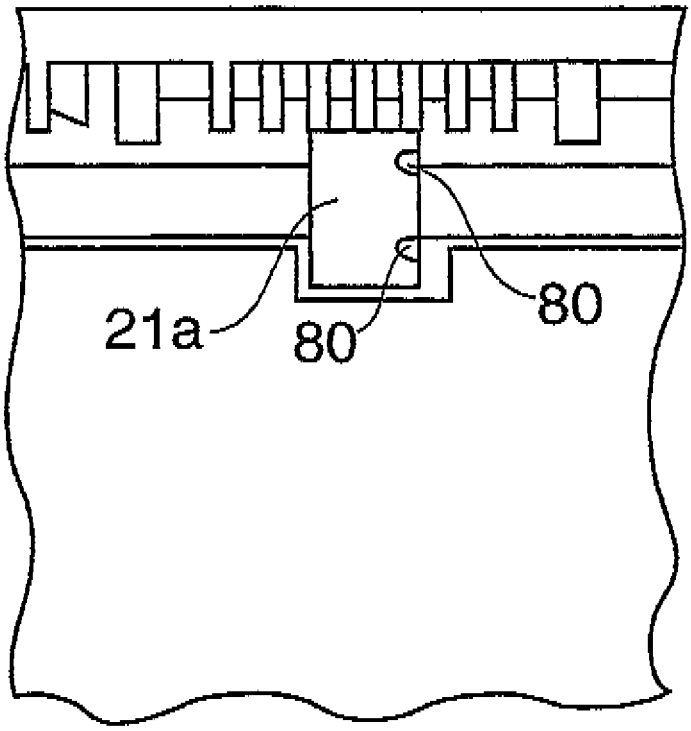
FIG. 12 is a view showing a structure of a main part in a color printer of a tandem type which serves as an image forming apparatus applying a paper transporting device according to a third embodiment of the invention.

FIG. 12 shows a third embodiment according to the invention. Description will be given by attaching the same reference numerals to the same portions as those in the embodiments described above. In the third embodiment, the driving roller member has such a structure that a plurality of concave portions dented inward in an axial direction is provided in an outer peripheral direction at an end facing a second guiding member formed to be partially protruded inward in the radial direction from an outer peripheral surface of the driving roller member.

More specifically, in the third embodiment, a shape of a driving roller 21*a* is different from that of the embodiment and the driving roller 21*a* does not take a cylindrical shape but a plurality of concave portions 80 dented inward in an axial direction is uniformly disposed on one of ends in the axial direction in a circumferential direction of the driving roller 21*a* as shown in FIG. 12.

The concave portion 80 of the driving roller 21*a* has such a structure as to exhibit a function for causing a rear end edge portion of a recording paper 16 to come in contact with an internal surface of the concave portion 80 and energizing and kicking out the rear end edge portion of the recording paper 16 in a tangential direction of the driving roller 21*a* by means of the concave portion 80 of the driving roller 21*a* to be rotated and driven when discharging the recording paper 16, thereby enhancing a discharging property of the recording paper 16.

Since the other structures and functions are the same as those of the embodiments, description thereof will be omitted.

Figure 13:
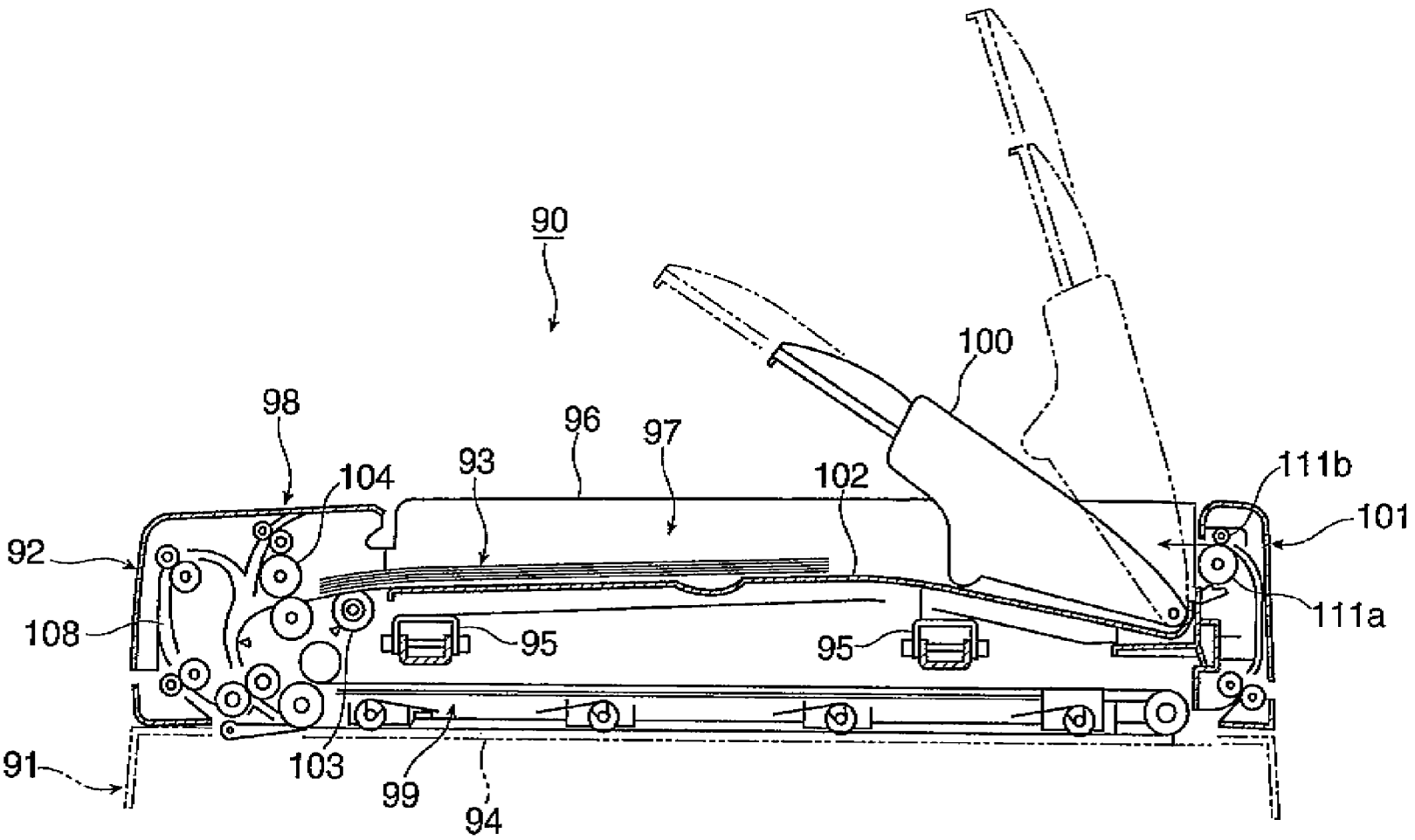
FIG. 13 is a view showing a structure of a document reading device applying a paper transporting device according to a fourth embodiment of the invention.

FIG. 13 shows a fourth embodiment according to the invention. Description will be given by attaching the same reference numerals to the same portions as those in the embodiments described above. In the fourth embodiment, there are provided an image reading portion for reading an image of a document and document transporting means for transporting the document from which the image is read by the image reading portion, and the paper transporting device described in the embodiments is used as the document transporting means.

More specifically, in an image reading device 90 according to the fourth embodiment, a double-sided automatic document feeding device 92 serving as document transporting means is provided on an image reading device body 91 as shown in FIG. 13. The image reading device body 91 is provided with a platen glass 94 for mounting, on an upper end face thereof, a document 93 from which an image is to be read. Moreover, a document illuminating lamp, a reflecting mirror, an imaging lens and an image reading element (which are not shown) for reading an image of the document 93 mounted on the platen glass 94 are disposed in the image reading device body 91.

Moreover, the double-sided automatic document feeding device 92 is openably attached to the image reading device body 91 by means of a hinge 95 provided on a back side of the double-sided automatic document feeding device (an inner side in a perpendicular direction to the drawing). The double-sided automatic document feeding device 92 is constituted by a sheet mounting portion 97 provided on an upper surface of a top cover 96, a paper feeding portion 98 for automatically transporting the document 93 depending on various job modes, a document registration portion 99 for positioning the document 93 on the platen glass 94 of the image reading device body 91, and a document discharging portion 101 for discharging the document 93 subjected to an image processing to a discharging tray 100.

Figure 14:
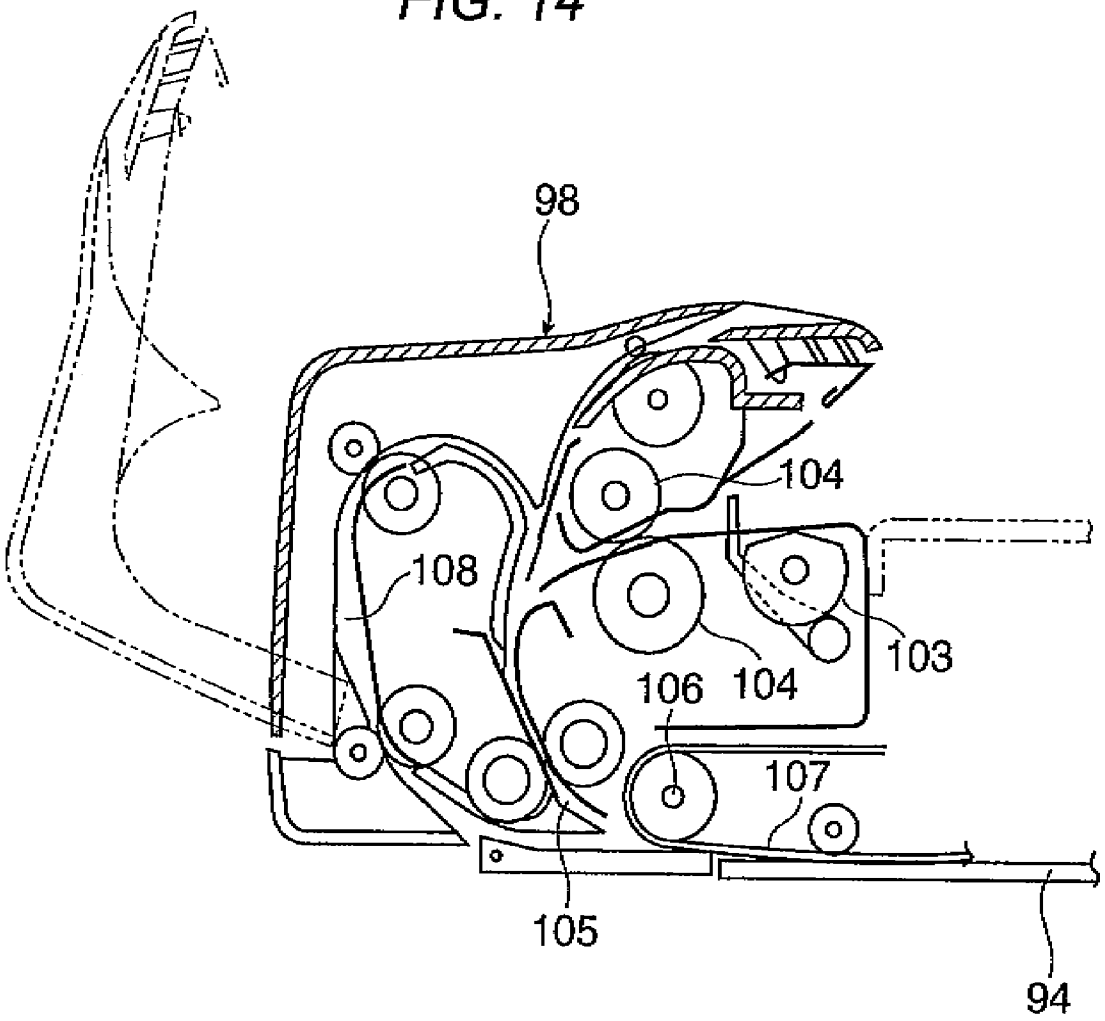
FIG. 14 is a view showing a structure of a main part in the document reading device applying the paper transporting device according to the fourth embodiment of the invention.

As shown in FIG. 14, the paper feeding portion 98 roughly includes a paper feeding roller 103 for feeding the document 93 set onto a sheet mounting table 102 from a document inlet, a document separating roller pair 104, a document transporting path 105 for transporting the document 93 to the platen glass 94, a transporting belt 107 to be driven by a roller 106 for transporting the document 93 to a predetermined position on the platen glass 94, and an inversion transporting path 108 for inverting a surface and a back face of the document 93.

Furthermore, the document discharging portion 101 includes a pair of discharging rollers 111, and first and second guiding members for guiding the document 93 to a contact portion (a nip portion) of the discharging roller 111, and has the same structure as that of the paper discharging device 31 shown in FIG. 1.

Since the other structures and functions are the same as those of the embodiments, description thereof will be omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A paper transporting device comprising:

a driving roller member that is rotated;

a driven roller member that is rotated in contact with the driving roller member;

a first guiding member that is disposed on a driving roller member side and that guides a paper to a contact portion in which the driving roller member and the driven roller member are in contact with each other; and a second guiding member (i) that is disposed on a driven roller member side, (ii) that guides the paper to the contact portion, and (iii) that partially protrudes radially inward from an outer peripheral surface of the driving roller member at a more downstream side than the contact portion, in a paper transporting direction, and at the contact portion, the second guiding member extends at least from the contact portion to a position located at a downstream side of the contact portion, wherein the second guiding member is configured to curve the paper, discharged from the contact portion, inward in the radial direction over the outer peripheral surface of the driving roller while passing through the contact portion and immediately after passing through the contact portion, wherein the second guiding member has a convex member having a convex shape, wherein the convex shape of the convex member is positioned at the contact portion such that a first portion of the convex member is disposed upstream from the contact portion and a second portion of the convex member is disposed downstream from the contact portion wherein the second portion of the convex shape of the convex member which protrudes radially inward from an outer peripheral surface of the driving roller member is longer in the paper transporting direction than the first portion of the convex shape of the convex member which protrudes radially inward from an outer peripheral surface of the driving roller member.

2. The paper transporting device according to claim 1, wherein the second guiding member is positioned along an axial direction of the driving roller member.

3. The paper transporting device according to claim 1, wherein the second guiding member is disposed adjacently to only the driving roller member for discharging a paper having a minimum size which is discharged by the paper transporting device.

4. The paper transporting device according to claim 1, wherein the second guiding member has the most protruded portion formed to be in parallel with the axial direction of the driving roller member.

5. The paper transporting device according to claim 1, wherein the driving roller member has a plurality of convex portions provided in an outer peripheral direction of the driving roller member, the convex portions protruding outward in the axial direction at an end of the driving roller member which faces the second guiding member.

6. The paper transporting device according to claim 1, wherein the driving roller member has a plurality of concave portions provided in an outer peripheral direction of the driving roller member, the concave portions denting inward in an axial direction of the driving roller member at an end of the driving roller which faces the second guiding member.

7. The paper transporting device according to claim 1, wherein the first and second guiding members are provided on a support member for rotatably supporting the driving roller member and the driven roller member.

8. An image forming apparatus comprising:

an image forming unit that forms an image on a paper; and the paper transporting device according to claim 1 that transports the paper on which the image is formed by the image forming unit.

9. An image reading device comprising:

an image reading unit that reads an image of a document; and the paper transporting device according to claim 1 that transports the document from which the image is read by the image reading unit.

10. A post-processing device comprising:

a post-processing unit that carries out a post-processing over a paper; and the paper transporting device according to claim 1 that transports the paper subjected to the post-processing by the post-processing unit.

11. The paper transporting device according to claim 1, wherein the sheet is pressed against the driving roller by the second guiding portion at a position immediately after the sheet has passed the contact portion.

12. The paper transporting device according to claim 1, wherein second guiding member is positioned to press the paper against the driving roller.

13. The paper transporting device according to claim 1, wherein a lower surface of second guiding member on a driven roller member side protrudes radially inside the outer peripheral surface of the driving roller member.

14. The paper transporting device according to claim 1, wherein a part of the second guiding member pushes the paper toward a radially inward direction from the outer peripheral surface of the driving roller member.

15. The paper transporting device according to claim 1, wherein a part of the second guiding member that protrudes radially inward from the outer peripheral surface of the driving roller member has a length, along the outer peripheral surface of the driving roller member at a downstream side of the contact portion which is larger than a length of the part of the second guiding member that protrudes radially inward from the outer peripheral surface of the driving roller member at an upstream side of the contact portion.

16. The paper transporting device according to claim 1, wherein the driving roller member has a larger diameter than a diameter of the driven roller member.

17. The paper transporting device according to claim 1, wherein the second guiding member is asymmetric about the contact portion.

* * * * *